US007469991B2

(12) United States Patent
Suzuki et al.

(10) Patent No.: US 7,469,991 B2
(45) Date of Patent: Dec. 30, 2008

(54) IMAGE FORMING APPARATUS AND IMAGE CORRECTION METHOD

(75) Inventors: Nobuhiro Suzuki, Tochigi-ken (JP); Hirobumi Tabata, Kawachi-gun (JP); Akihiko Koshimizu, Utsunomiya (JP)

(73) Assignee: Panasonic Corporation, Osaka (JP)

( * ) Notice: Subject to any disclaimer, the term of this patent is extended or adjusted under 35 U.S.C. 154(b) by 334 days.

(21) Appl. No.: 11/277,242

(22) Filed: Mar. 23, 2006

(65) Prior Publication Data

US 2006/0227202 A1 Oct. 12, 2006

(30) Foreign Application Priority Data

Apr. 6, 2005 (JP) ..... 2005/109796

(51) Int. Cl.
*B41J 2/21* (2006.01)

(52) U.S. Cl. ..... 347/43; 347/116

(58) Field of Classification Search ..... 347/15, 347/43, 116; 358/518
See application file for complete search history.

(56) References Cited

U.S. PATENT DOCUMENTS 6,008,912 A 12/1999 Sato et al.
6,297,872 B1 * 10/2001 Imamura et al. ..... 355/40
6,771,832 B1 8/2004 Naito et al.
6,989,872 B2 1/2006 Nakatsuji et al.
2004/0239747 A1 * 12/2004 Maeda ..... 347/116
2005/0141025 A1 6/2005 Hanada

FOREIGN PATENT DOCUMENTS

JP 2000159395 A * 6/2000
JP 2001-290327 10/2001

OTHER PUBLICATIONS

English Language Abstract of JP 2001-0141025.

* cited by examiner

*Primary Examiner*—Thinh H Nguyen
(74) *Attorney, Agent, or Firm*—Greenblum & Bernstein, P.L.C.

(57) ABSTRACT

An image forming apparatus includes a counter that counts the accumulated number of predetermined printed recording sheets and an image correction controller that performs an image correction operation when the accumulated number of recording sheets reaches a predetermined number. The image forming apparatus is configured to advance an execution timing of the image correction operation, depending on its predetermined operating status.

20 Claims, 12 Drawing Sheets

Fig.8

| | Required accumulated number | Operating status | | Exection timing of image correction operation |
|---|---|---|---|---|
| Compulsory execution | Accumulation no. after previous image correction operation Accumulated no. =N | Normal continuous printing | | Upon completion of printing of page N (completion of paper ejection) |
| Advancing execution | Accumulated no. after previous image correction operation N-X ≦ accumulated no. <N | On standby | Print job complete | When predetermined time elapsed without user operation after print job is completed |
| | | | Power-save mode | When automatically switched to power-save mode |
| | | | Sleep mode | When switched to sleep mode after power-save mode manually activated |
| | | In operation | Continuous single-side/ duplex printing (post-printing process follows) | Upon completion of processing of recording sheet undergoing post-printing process |
| | | | Continuous duplex printing (no · post-printing process follows) | Upon completion of duplex printing of recording sheet |
| | | | Continuous single-side printing (no · post-printing process follows) | None(printing continuous) |

IMAGE FORMING APPARATUS AND IMAGE CORRECTION METHOD

BACKGROUND OF THE INVENTION

1. Field of the Invention

The present invention relates to an image forming apparatus and an image correction method that perform an image correction operation, such as a color shift correction, for maintaining image forming quality.

2. Description of Related Art

Conventionally, an image forming apparatus that forms images using an electro photographic process such as a printer, a copier and a multifunction apparatus having printer and copier functions has been expected to reliably form high-quality images, amid recent trends toward full color, high quality pictures. To reliably form high-quality images, it is necessary to improve part precision and attachment precision of various components of an apparatus in the process of designing, manufacturing and adjusting of the apparatus. Those components include a laser scanning unit, a transfer belt and a photoconductor that are related to image formation. It is further necessary to consider effects over time, including a temperature change of components when using the apparatus. Therefore, there is a need to perform predetermined image correction operations, such as color shift correction, employed by a tandem system color image forming apparatus.

As a technology related to execution of such an image correction operation, an apparatus designed to maintain image quality without lowering image formation efficiency is available. For example, a color image forming apparatus is configured to form on a transfer belt a displacement detection pattern for detecting a displacement during a color image formation and to correct the pattern displacement based on detection results by a detector. Such color image forming apparatuses include a color image forming apparatus configured to extend, by a predetermined length, intervals for conveying sheets from a feeder to a transfer belt when the counted number of continuous printing exceeds a predetermined number, and to form a displacement modification pattern on the transfer belt at the extended intervals for conveying sheets (See Relate Art 1).

[Related Art 1] Japanese Patent Laid-open Publication 2001-290327

However, in the technology disclosed in Related Art 1, when the counted number of continuous printing exceeds a predetermined standard number (i.e., when image correction becomes necessary), intervals for conveying recording sheets from a feeder to a transfer belt are extended. Therefore, when the counted number of continuous printing exceeds the predetermined standard number while a print job for continuous printing is in progress, an interval between a start and an end of the print job becomes longer, thus resulting in a longer waiting time for users.

Further, when the counted number of continuous printing exceeds the predetermined standard number during duplex printing or printing using finishing features (sorting, stapling, punching, etc.), users may have to wait while a recording sheet remains in the apparatus after its one side has been printed, or while a printed sheet remains in a buffer tray for a finishing process. In that case, users may misunderstand that a jamming problem or an error has occurred, even though the apparatus is normally operating.

SUMMARY OF THE INVENTION

The present invention is provided to address the above-described problems. The main objective of the present invention is to provide an image forming apparatus and its image formation method that are capable of performing an image correction operation at an appropriate timing in accordance with an operating status of the apparatus, thereby reducing a waiting time for the user to improve usability.

To solve the above-noted problems, the image forming apparatus according to the present invention is configured to appropriately perform a predetermined image correction operation during an image forming operation, so as to form an image of constant quality in an electro photographic process. The image forming apparatus includes a counter and an image correction controller, the counter configured to count the accumulated number of printed recording sheets, the image correction controller executing an image correction operation when the accumulated number of counted recording sheets reaches a predetermined number. The image forming apparatus is configured to advance an execution timing of an image correction operation, according to its predetermined operating status.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein:

FIG. 8 is a view illustrating an overview of an advancing process of an image correction operation;

DETAILED DESCRIPTION OF PREFERRED EMBODIMENTS

The embodiments of the present invention are explained in the following with reference to the above-described drawings.

Figure 1:
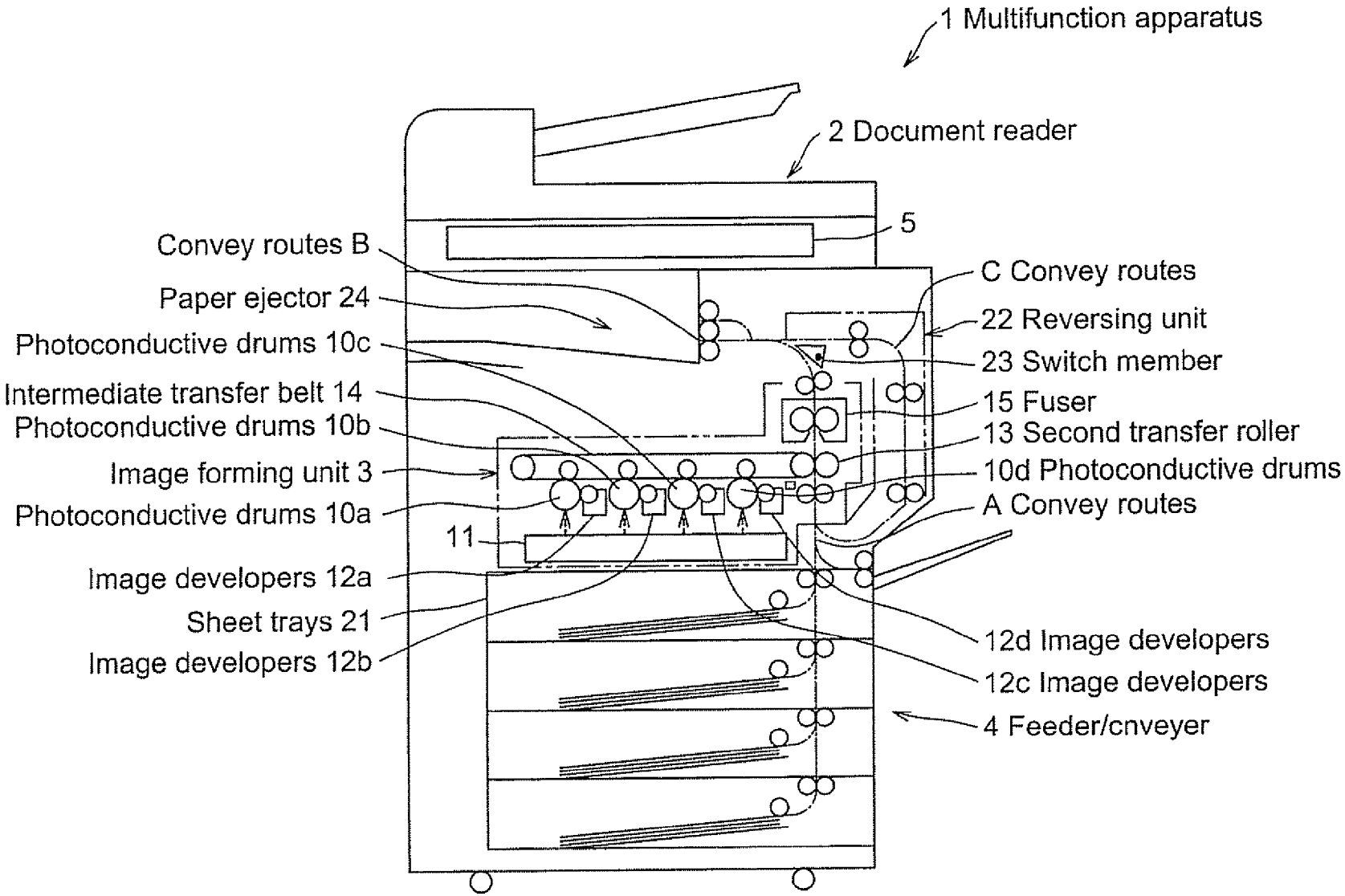
FIG. 1 is a view showing a schematic configuration of a multifunction apparatus according to the present invention.

FIG. 1 is a view showing a schematic configuration of a multifunction apparatus according to the present invention.

Multifunction apparatus (image forming apparatus) 1 includes document reader 21 image forming unit 3 and feeder/conveyer 4. Document reader 2 reads an image of a document. Image forming unit 3 forms one of a color image and a black-and-white image on a recording sheet, based on predetermined image data in an electro photographic process. Feeder/conveyer 4 conveys a stored recording sheet along convey routes A to C.

Document recorder 2 includes reading unit 5 having a line sensor for reading an image of a document and generates image data used for image forming unit 3 to perform image formation. Image data used for such image formation are not limited to those generated by document reader 2 and may be received from a terminal apparatus, such as a PC (Personal Computer), via a network as print job data and the like (described later).

Image forming unit 3 employs a so called 4 tandem system and includes photoconductive drums 10*a* to 10*d*, LSU (Laser Scanning Unit) 11, image developers 12*a* to 12*d*, intermediate transfer belt 14 and fuser 15. Photoconductive drums 10*a* to 10*d* form toner images per color components, i.e., Y (Yellow), M (Magenta), C (Cyan) and K (Black). LSU 11 scans a laser beam over image formation surfaces of photoconductive drums 10*a* to 10*d* and forms electrostatic latent images, photoconductive drums 10*a* to 10*d* being evenly charged by a charging device (not shown). Image developers 12*a* to 12*d* respectively develop the electrostatic latent images on the image formation surfaces, using toners of the respective components. Intermediate transfer belt 14 sequentially transfers toner images of the respective color components, and then transfers a combined toner image on a recording sheet inserted between intermediate transfer belt 14 and second transfer roller 13. Fuser 15 performs a fusing operation on the toner image transferred on the recording sheet.

Feeder/conveyer 4 includes sheet trays 21 that hold recording sheets and a group of rollers that conveys recording sheets along convey routes A to C. Feeder/conveyer 4 includes reversing unit 22 configured to reverse recording sheets in duplex printing. Reversing unit 22 may switch between convey route B for paper ejection toward paper ejector 24 and convey route C for paper reversion by operating switch member 23. Reversing unit 22 may form a toner image on an unprinted reverse side of a recording sheet by feeding the recording sheet having one side printed to image forming unit 3 via convey route C.

Multifunction apparatus 1 may perform, as a post-printing process, a sort function in which sheets are ejected onto a tray of paper ejector 24 at slightly different locations. Multifunction apparatus 1 may further perform post-printing processes, including stapling and punching, by using a finisher (not shown).

Figure 2:
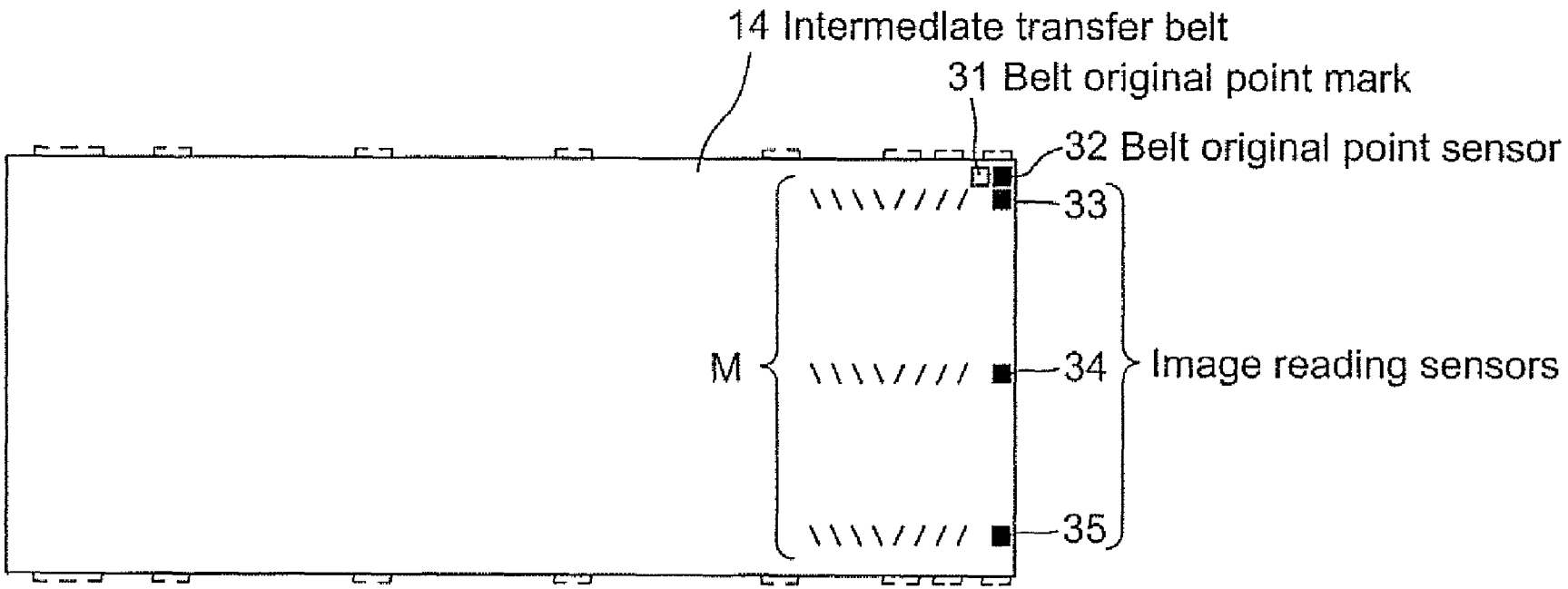
FIG. 2 is a plain view showing locations of respective sensors relative to an intermediate transfer belt of the multifunction apparatus shown in FIG. 1.

FIG. 2 is a plain view showing locations of respective sensors for the intermediate transfer belt of the multifunction apparatus shown in FIG. 1. In the vicinity of intermediate transfer belt 14, belt original point sensor 32 and image reading sensors 33 to 35 are provided. Belt original point sensor 32 is configured to read belt original point mark 31 that indicates an original point of intermediate transfer belt 14. Image reading sensors 33 to 35 are configured to detect detection marks M formed on intermediate transfer belt 14 for color shift correction and the like. As shown in FIG. 2, belt original point sensor 32 is located so as to detect belt original point mark 31 formed at one end of its width direction when intermediate transfer belt 14 is rotated. Image reading sensors 33 to 35 are located so as to detect three rows of detection marks M formed in a substantially central region and near both ends of a main scanning direction (width direction) when intermediate transfer belt 14 is rotated. As described later, multifunction apparatus 1 is capable of performing an image correction operation by using the above-described sensors 32 to 35 while image forming unit 3 performs an image forming operation.

Figure 3:
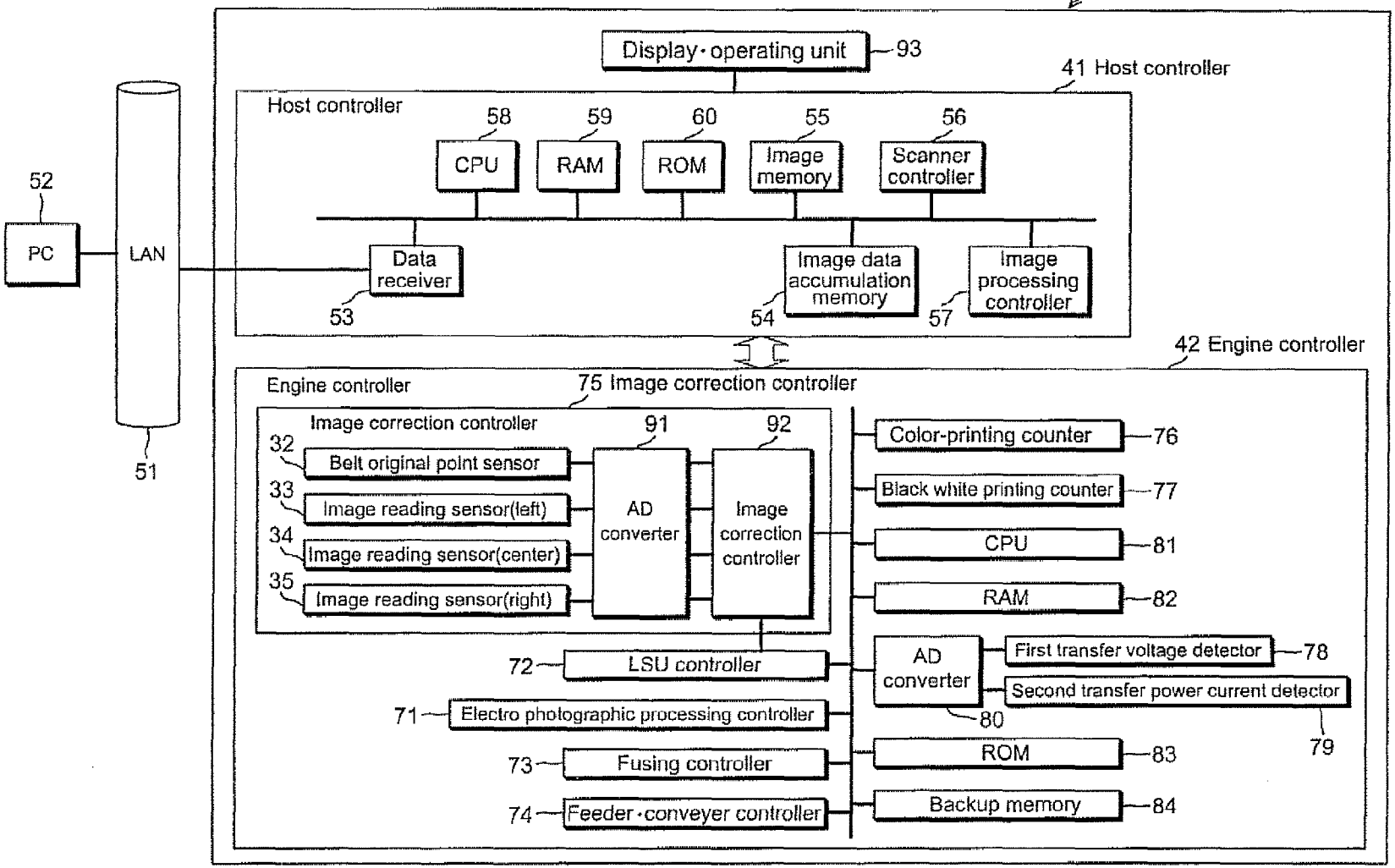
FIG. 3 is a block diagram illustrating a schematic configuration of a control system of the multifunction apparatus shown in FIG. 1.

FIG. 3 is a block diagram illustrating a schematic configuration of a control system of multifunction apparatus 1 shown in FIG. 1. The control system of multifunction apparatus 1 mainly includes host controller 41 and engine controller 42. Host controller 41 is configured to comprehensively control operations of multifunction apparatus 1. Engine controller 42 is configured to control operations of image forming, fusing, feeding/conveying and image correction.

Host controller 41 includes data receiver 53, image data accumulation memory 541 image memory 55, scanner controller 56, image processing controller 57, CPU 58, RAM 59 and ROM 60. Data receiver 53 receives, from PC 52 and other terminal apparatuses (not shown) connected to host controller 41 via LAN (Local Area Network) 51, print job data (including image data and output setting data specifying an output format for the image data) and the like. Image data accumulation memory 54 sequentially stores the print job data received from data receiver 53. Image memory 55 stores print job data rasterized by a rasterizer (not shown). Scanner controller 56 controls a scanning function of document reader 2. Image processing controller 57 controls an image processor (not shown) for performing various image processing operations on image data. CPU 58 comprehensively controls operations of these units. RAM 59 provides a work area for CPU 58 to control the operations of these units. ROM 60 stores control programs for CPU 58 to control the operations of these units.

Engine controller 42 includes: electro photographic processing controller 71 that comprehensively controls an electro photographic process of image forming unit 3, LSU controller 72 that controls laser scanning and the like performed by LSU 11, fusing controller 73 that controls a fusing operation of fuser 15, feeder/conveyer controller 74 that controls paper feeding and conveying operations of feeder/conveyer 4, image correction controller 75 that controls a series of image correction operations, including color shift correction performed during an image forming operation of image forming unit 3, color-printing counter (counter) 76 that counts the number of color prints, black-and-white printing counter (counter) 77 that counts the number of black-and-white prints, first transfer voltage detector 78 that monitors a voltage related to a first transfer, second transfer power current detector 79 that monitors a power current related to a second transfer, AD (Analog-to-Digital) converter 80 that converts signals from detectors 78 and 79, CPU 81 that comprehensively controls operations of these units, RAM 82 that provides a work area for CPU 81 to control the operations of these units, ROM 83 that stores control programs for CPU 81 to control operations of image forming, fusing, feeding/conveying and image correction, and backup memory 84 that stores data, such as correction degrees, for an image correction operation.

Image correction controller 75 has a configuration in which belt original point sensor 32 and image reading sensors 33 to 35 are connected to image correction controller 92 via AD (Analog-to-Digital) converter 91. Image correction controller 92 performs an image correction operation at an appropriate timing, based on detection results by image reading sensors 32 to 35. In this example, image correction controller 75 is configured to individually perform an image correction operation for color-printing and an image correction operation for black-and-white printing, based on count values indicated by counters 76 and 77.

The user may have multifunction apparatus 1 described in the above-noted embodiment perform desired print jobs by placing a document on document reader 2 and operating input keys of display/operating unit 93 and by using a printer driver (not shown) of PC 52 to transmit print job data.

Figure 4:
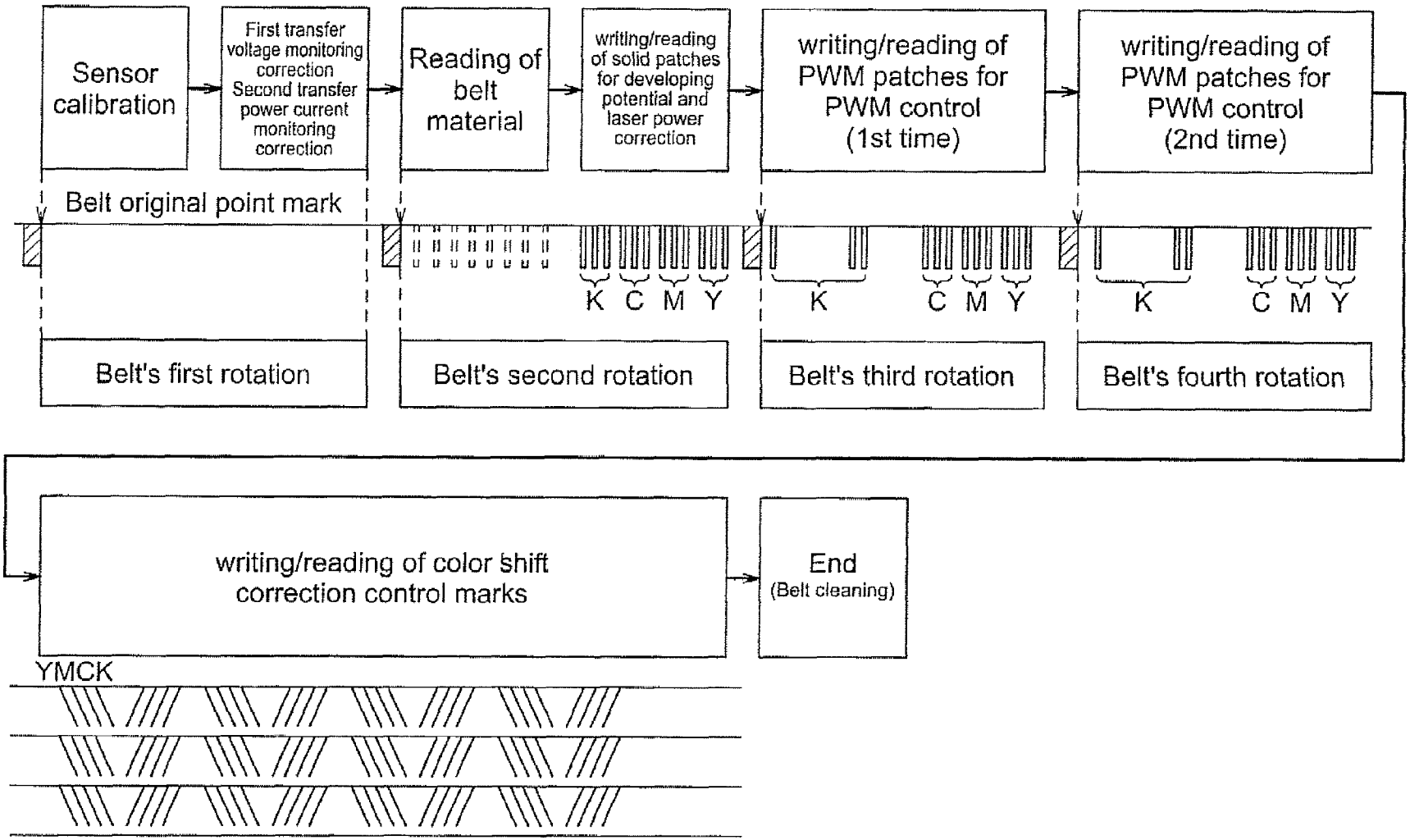
FIG. 4 is a schematic diagram illustrating an overview of an image correction operation for color-printing.
Figure 5:
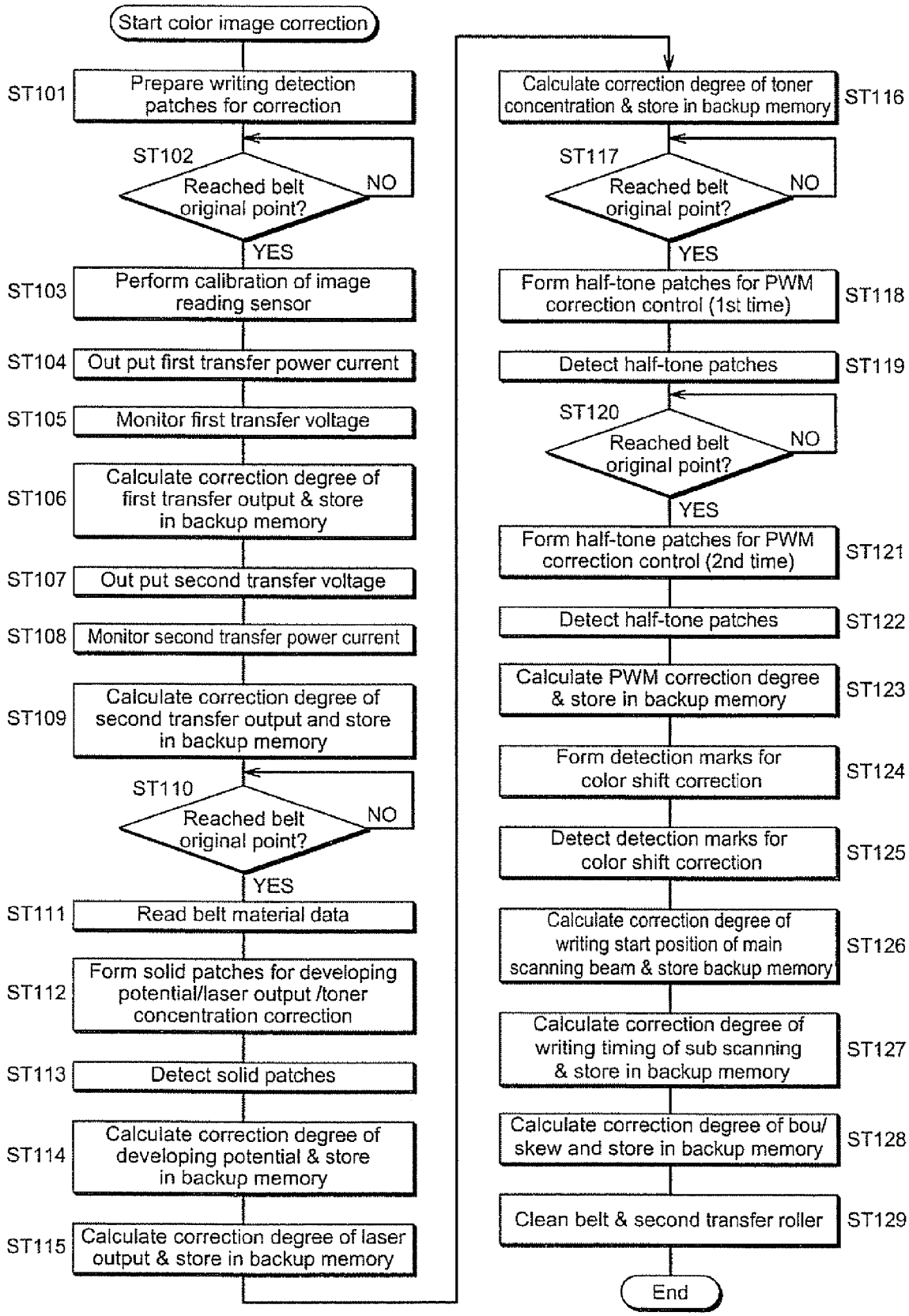
FIG. 5 is a flowchart illustrating the image correction operation for color-printing

FIG. 4 is a schematic diagram illustrating an overview of an image correction operation for color-printing, and FIG. 5 is a flowchart illustrating the image correction operation for color-printing.

FIG. 4 schematically shows, in addition to a series of image correction operations, detection marks for correction formed on intermediate transfer belt 14 during such image correction operations, and relations between respective image correction operations and rotations of intermediate transfer belt 14. This image correction operation for color-printing usually starts when it is determined, based on a count value indicated by color-printing counter 76, that the accumulated number of recording sheets of color-printing has reached a predetermined number after the previous image correction operation for color-printing. Each operation is performed in synch with a rotation of intermediate transfer belt 14, based on a reading timing of belt original point mark 31 by belt original point sensor 32.

The following will describe a flow of the image correction operation for color-printing shown in FIG. 5 with reference to FIG. 4.

As shown in FIG. 5, when the image correction operation starts, preparations (including start-up of the apparatus) for forming detection patches for correction are first performed (ST101). When belt original point mark 31 is detected for the first time by belt original point sensor 32 (ST102: Yes), calibrations of image reading sensors 33 to 35 are performed as "sensor calibrations" shown in FIG. 4 (ST103). Next, a power current related to a first transfer is output as "first transfer voltage monitoring correction, second transfer power current monitoring correction" (ST104); a voltage output related to the first transfer is obtained by detector 78 (ST105); and a correction degree related to the voltage output is calculated and stored in backup memory 84 (ST106). Similarly, a voltage related to the second transfer is output (ST107); a power current output related to the second transfer is obtained by detector 79 (ST108), and a correction degree related to the power current output is calculated and stored in backup memory 84 (ST109).

Next, when belt original point mark 31 is detected for the second time by belt original point sensor 32 (ST1110: Yes), a reading is performed as "reading of belt material" shown in FIG. 4 on a belt material at a position where a K-colored detection mark is formed (ST111). The K-colored detection mark serves as a standard detection mark for correction. The read data are used to improve a reading precision of the K-colored detection mark in PWM (Pulse Width Modulation) correction control (described later). Next, Y-, M-, C- and K-colored detection marks (solid patches) are formed on intermediate transfer belt 14 (ST112). These colors are used for "writing/reading of solid patches for developing potential correction and laser output correction". After these detection marks are read by image reading sensors 33 to 35 (ST113), a correction degree related to developing potentials and toner concentrations of developers 12*a* to 12*d* and a correction degree related to a laser output by LSU 11 are calculated and respectively stored in backup memory 84 (ST114-ST116).

Next, when belt original point mark 31 is detected for the third time by belt original point sensor 32 (ST117: Yes), Y-, M-, C- and K-colored detection marks (half-tone patches) are formed on intermediate transfer belt 14 as "writing/reading of PWM patches for PWM control (for the first time)" as shown in FIG. 4 (ST118). These detection marks are read by image reading sensors 33 to 35 (ST119). Similarly, belt original point mark 31 is detected for the fourth time by belt original point sensor 32 (ST120: Yes), Y-, M-, C- and K-colored detection marks (half-tone patches) are re-formed on intermediate transfer belt 14 as "writing/reading of PWM patches for PWM control (for the second time)" (ST121). These detection marks are then read by image reading sensors 33 to 35 (ST122). Based on reading results of the detection marks, a correction degree related to the PWM control is calculated for a laser lighting time of LSU 11 and stored in backup memory 84 (ST123).

Next, Y-, M-, C- and K-colored detection marks for color shift correction are formed on intermediate transfer belt 14 as "writing/reading of color shift correction marks" shown in FIG. 4 (ST124). After these detection marks are read by image reading sensors 33 to 35 (ST125), a correction degree related to a writing start position of a main scanning laser beam projected by LSU 11, a correction degree related to a writing start time of sub scanning, and a correction degree related to bow/skew correction for correcting image signals per main scanning block by rearranging sub scanning lines are calculated and respectively stored in backup memory 84 (ST126-ST128). After that, intermediate transfer belt 14 and second transfer roller 13 are cleaned (ST129), thereby completing the image correction operation for color-printing.

Figure 6:
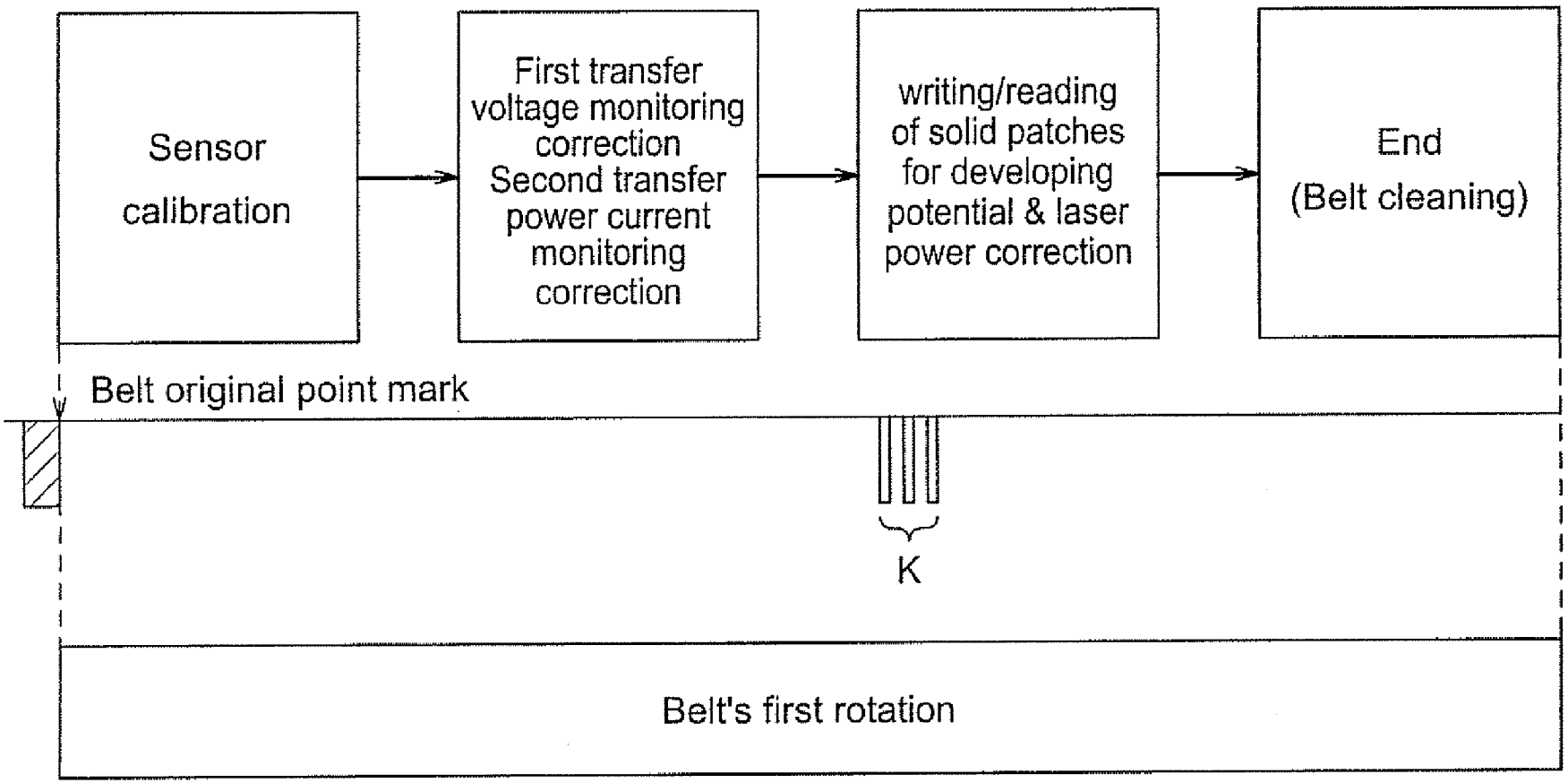
FIG. 6 is a schematic diagram illustrating an overview of an image correction operation for black-and-white printing.
Figure 7:
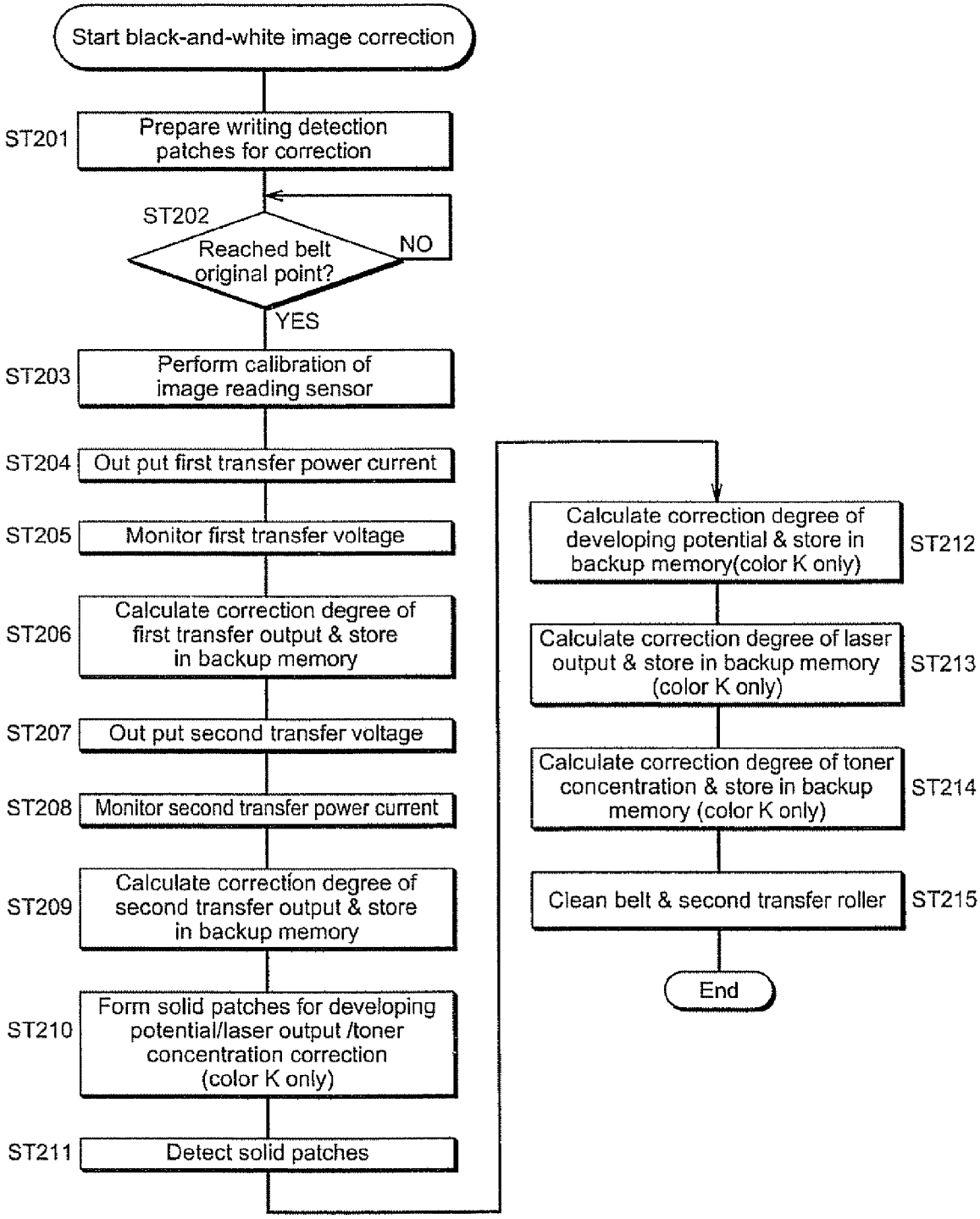
FIG. 7 is a flowchart illustrating the image correction operation for black-and-white printing.

FIG. 6 is a schematic diagram illustrating an overview of an image correction operation for black-and-white printing, and FIG. 7 is a flowchart illustrating the image correction operation for black-and-white printing.

Similar to FIG. 4, FIG. 6 schematically shows, in addition to a series of image correction operations, detection marks for correction formed on intermediate transfer belt 14 during such image correction operations, and relations between respective image correction operations and rotations of intermediate transfer belt 14. This image correction operation for black-and-white printing usually starts when it is determined, based on a count value indicated by black-and-white printing counter 77, that the accumulated number of recording sheets of black-and-white printing has reached a predetermined number after the previous image correction operation for color-printing or black-and-white printing. An image correction operation for color-printing substantially includes an image correction operation for black-and-white printing. Therefore, the accumulated number of recording sheets is reset even when an image correction operation for color-printing is performed. Each operation is performed in synch with a rotation of intermediate transfer belt 14, based on a reading timing of belt original point mark 31 by belt original point sensor 32.

The following will describe a flow of the image correction operation for black-and-white printing with reference to FIG. 6.

As shown in FIG. 7, when the image correction operation starts, preparations (including start-up of the apparatus) for forming detection patches for correction are first performed (ST201). When belt original point mark 31 is detected by belt original point sensor 32 (ST202: Yes), calibrations of image reading sensors 33 to 35 are performed as "sensor calibrations" shown in FIG. 6 (ST203). Next, a power current related to a first transfer is output as "first transfer voltage monitoring correction, second transfer power current monitoring correction" shown in FIG. 6 (ST204); a voltage output related to the first transfer is obtained by detector 78 (ST205); and a correction degree related to the voltage output is calculated and stored in backup memory 84 (ST206). Similarly, a voltage related to a second transfer is output (ST207); a power current output related to the second transfer is obtained by detector 79 (ST208); and a correction degree related to the power current output is calculated and stored in backup memory 84 (ST209).

Next, K-colored detection marks (solid patches) are formed on intermediate transfer belt 14 as "writing/reading of solid patches for developing potential correction and laser output correction" (ST210). When the K-colored detection marks are read by image reading sensors 33 to 35 (ST211), a correction degree related to a developing potential and a toner concentration of image developer 12*d* and a correction degree related to a laser output by LSU 11 are calculated and stored in backup memory 84 (ST212-ST214). After that, intermediate transfer belt 14 and second transfer roller 13 are cleaned (ST215), thereby completing the image correction operation for black-and-white printing.

FIG. 8 shows an overview of an advancing process of an image correction operation. As previously described, an image correction operation for one of color-printing and black-and-white printing usually starts when the accumulated number of printed recording sheets exceeds a predetermined number. In addition, image correction controller 75 may advance an execution timing of the image correction operation shown in FIGS. 4-7 according to an operating status of multifunction apparatus 1.

In other words, as shown in FIG. 8, multifunction apparatus 1 may set conditions for "advancing execution" in addition to "forcible execution" as a timing to start the image correction operation: "forcible execution" performs an image correction operation when the accumulated number of printed recording sheets reaches a predetermined number N; and "advancing execution" advances an execution timing of an image correction operation.

In the forcible execution, the accumulated number of printed recording sheets after the previous image correction operation needs to be equal to the predetermined number N (accumulated number=N). The predetermined number N may be set as a value at which images of constant quality can be formed without performing an image correction operation. It is further possible to set different values for an image correction operation for color-printing and an image correction operation for black-and-white printing. In the forcible execution, there is no restriction on an operating status of multifunction apparatus 1. When the above-noted condition of the accumulated number is met during normal continuous printing, an image correction operation is performed upon completion of printing of the predetermined number N (upon completion of paper ejection).

On the other hand, in the advancing execution, the accumulated number of printed recording sheets after the previous image correction operation needs to be smaller than the predetermine number N and equal to or larger than N−X. In other words, the accumulated number needs to be within a predetermined range of numbers (N−X≦accumulated number<N). X may be set by considering the followings: status of use of multifunction apparatus 1, increase in toner consumption due to an advancing execution of the image correction operation, and remaining component life (e.g., a photoconductive drum).

In the advancing execution, depending on an operating status of multifunction apparatus 1, that is, whether it is on standby (not in operation) or whether continuous printing is in progress, an image correction operation is performed at a different timing. When multifunction apparatus 1 is on standby, an image correction operation is performed when the above-noted condition of the accumulated number is met and no user operation occurs, such as occurrence of a new print job after completion of a print job. In addition, multifunction apparatus 1 is configured to activate a power-save mode upon completion of the print job, the power-save mode being for reducing electric consumption by lowering a fusing temperature on standby. An image correction operation is performed multifunction apparatus 1 automatically enters a power-save mode as meeting a predetermined condition and without being operated by the user. Furthermore, multifunction apparatus 1 may be configured to switch to a sleep mode after entering the power-save mode upon completion of the print job, the sleep mode enabling a greater reduction in power consumption on standby than the power-save mode. An image correction operation is performed when multifunction apparatus 1 automatically enters a sleep mode as meeting a predetermined condition, after manually set to power-save mode by the user.

Here, in multifunction apparatus 1, when the user activates the power-save mode, compared to when the power-save mode is automatically on, it is more likely that the user restarts the apparatus immediately afterwards. In this case, multifunction apparatus 1 is configured to suspend an image correction operation performed in the power-save mode, and perform an image correction operation when switching to the sleep mode. Therefore, even when the user restarts the apparatus immediately after the power-save mode is manually on, it is possible to save the user unnecessary waiting time, stress and confusion.

On the other hand, when multifunction apparatus 1 is in operation, an image correction operation is performed at a different timing, depending on whether a post-printing process (sorting, stapling, punching, etc) is performed after printing, and whether it is for single-side printing or duplex printing. When it is necessary to perform a post-printing process after single-side printing or duplex printing, an image correction operation is performed upon completion of all the operations for a collection of recording sheets undergoing a post-printing process. In duplex printing that requires no post-printing process, an image correction operation is performed when a recording sheet having one side printed does not exist in reversing unit 22 or the like, which reverses recording sheets (upon completion of duplex printing). In addition, in single-side printing that requires no post-printing process, printing continues even after the above-noted condition of the accumulated number is met.

FIGS. 9 through 12 are flowcharts illustrating advancing processes of the image correction operation.

Figure 9:
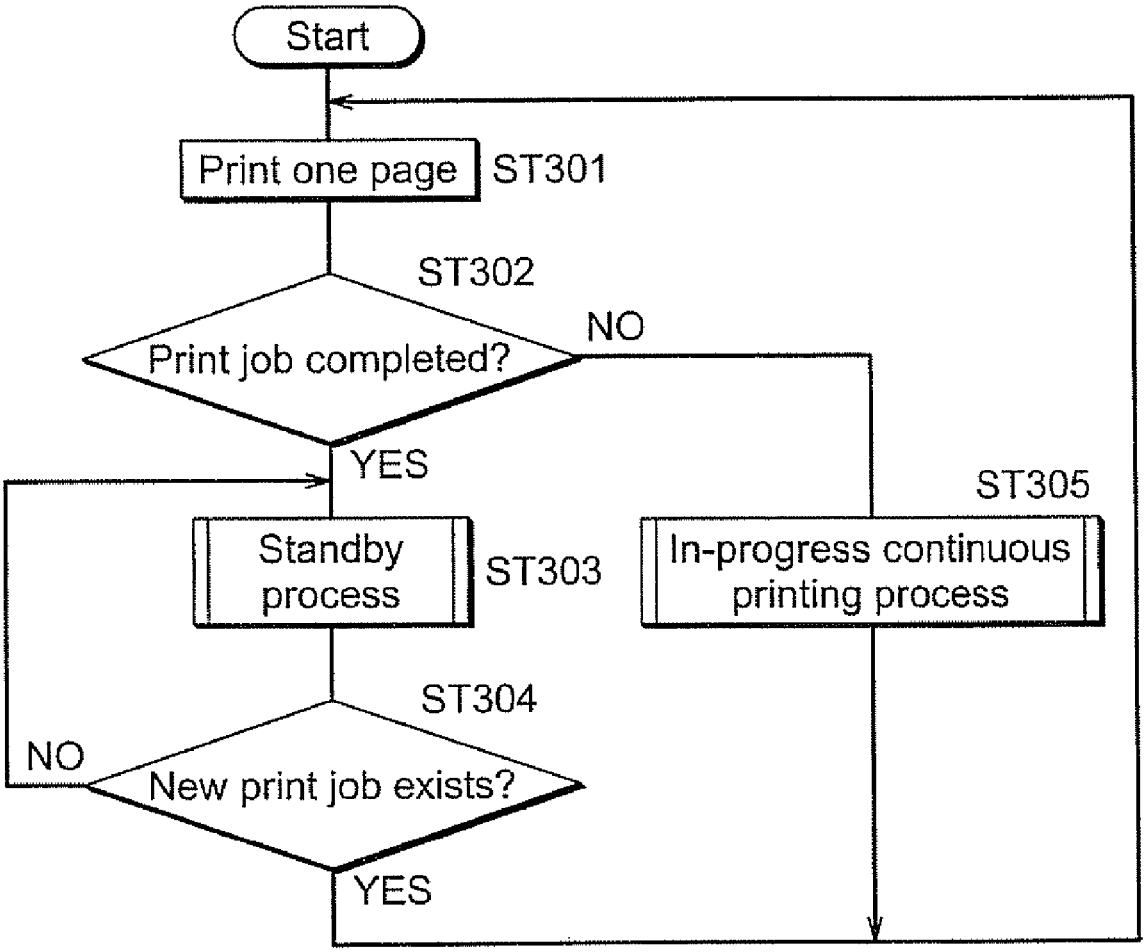
FIG. 9 is a flowchart illustrating an advancing process of the image correction operation.
Figure 10:
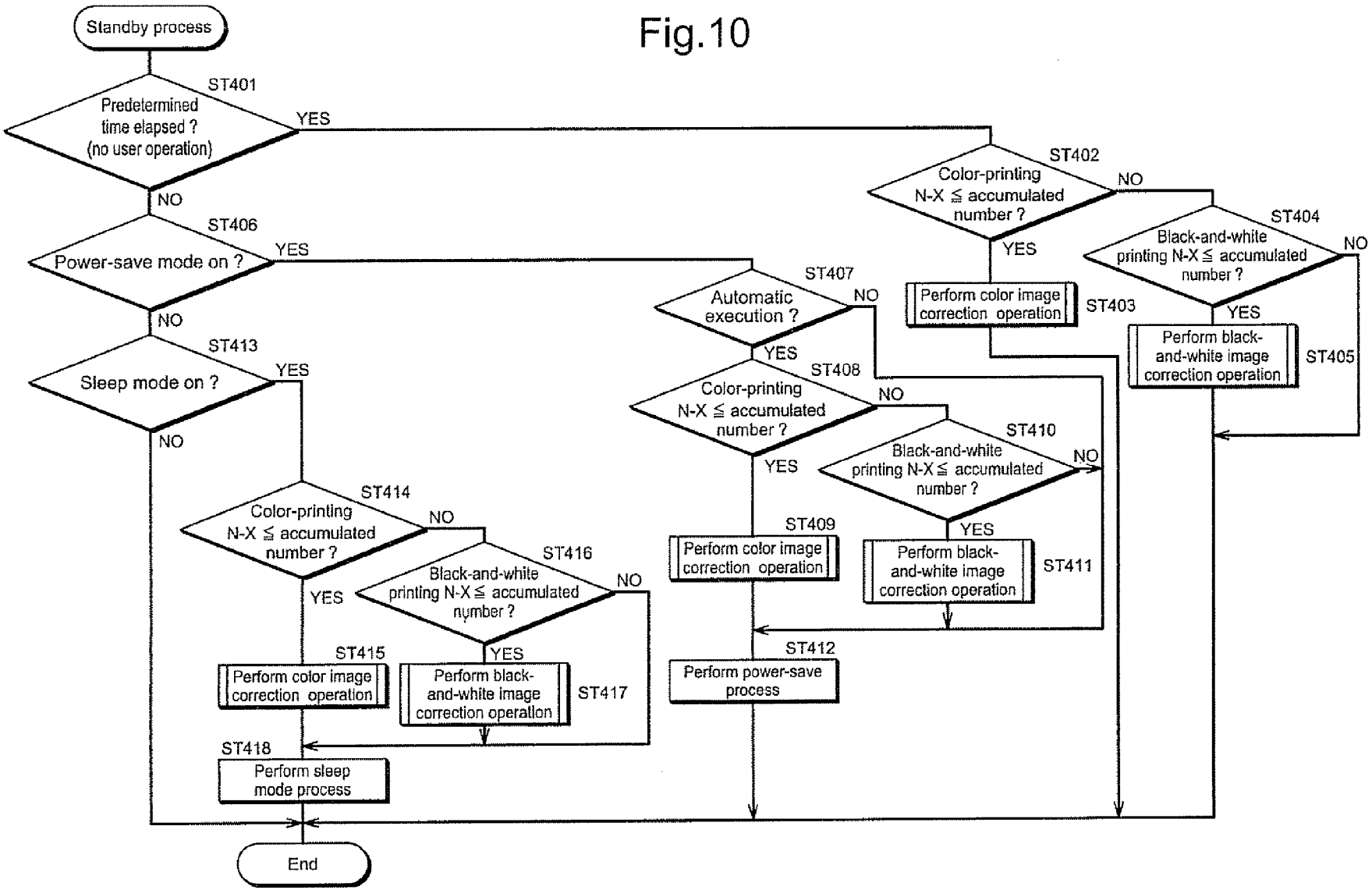
FIG. 10 is a flowchart illustrating an advancing process of the image correction operation.
Figure 11:
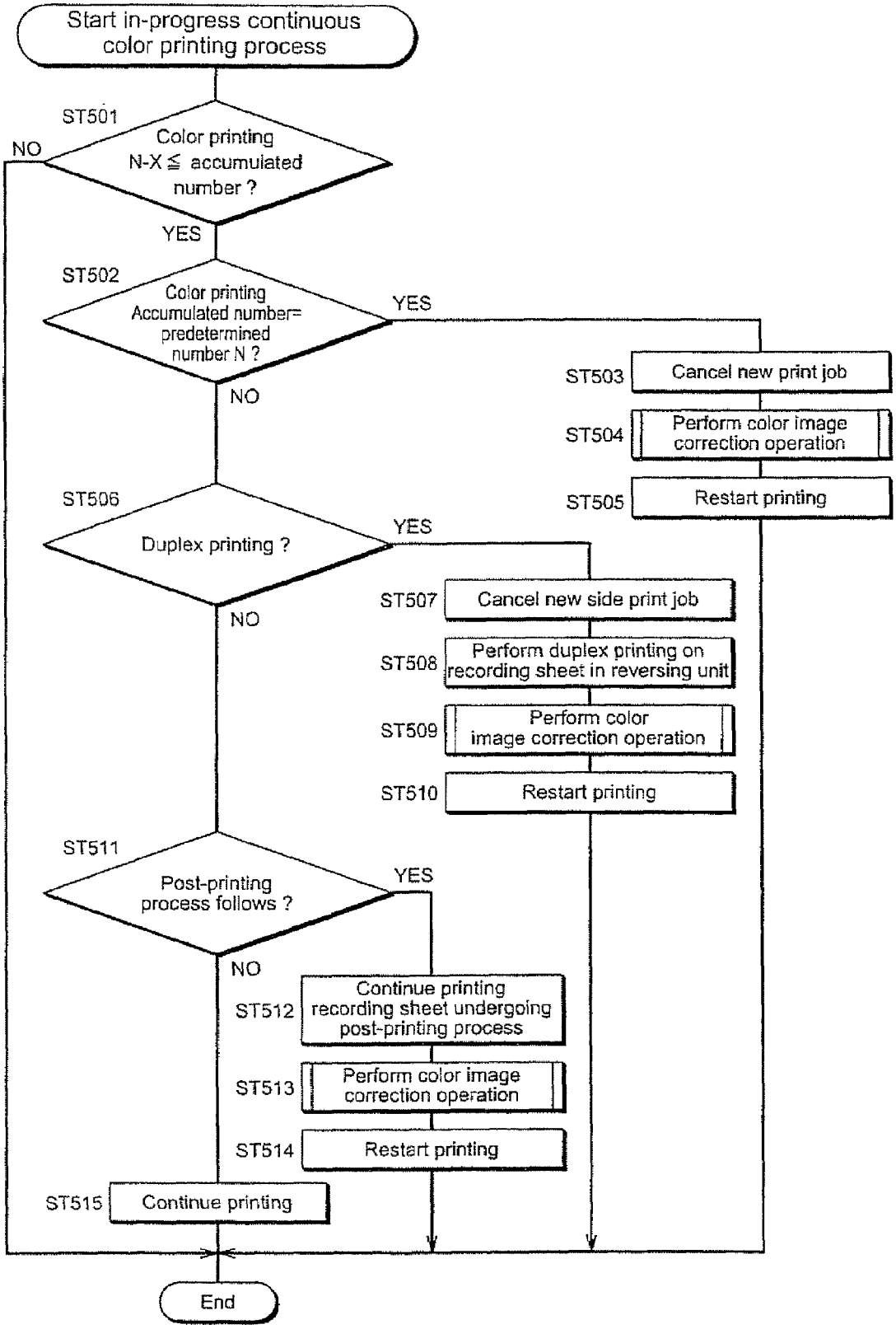
FIG. 11 is a flowchart illustrating an advancing process of the image correction operation.
Figure 12:
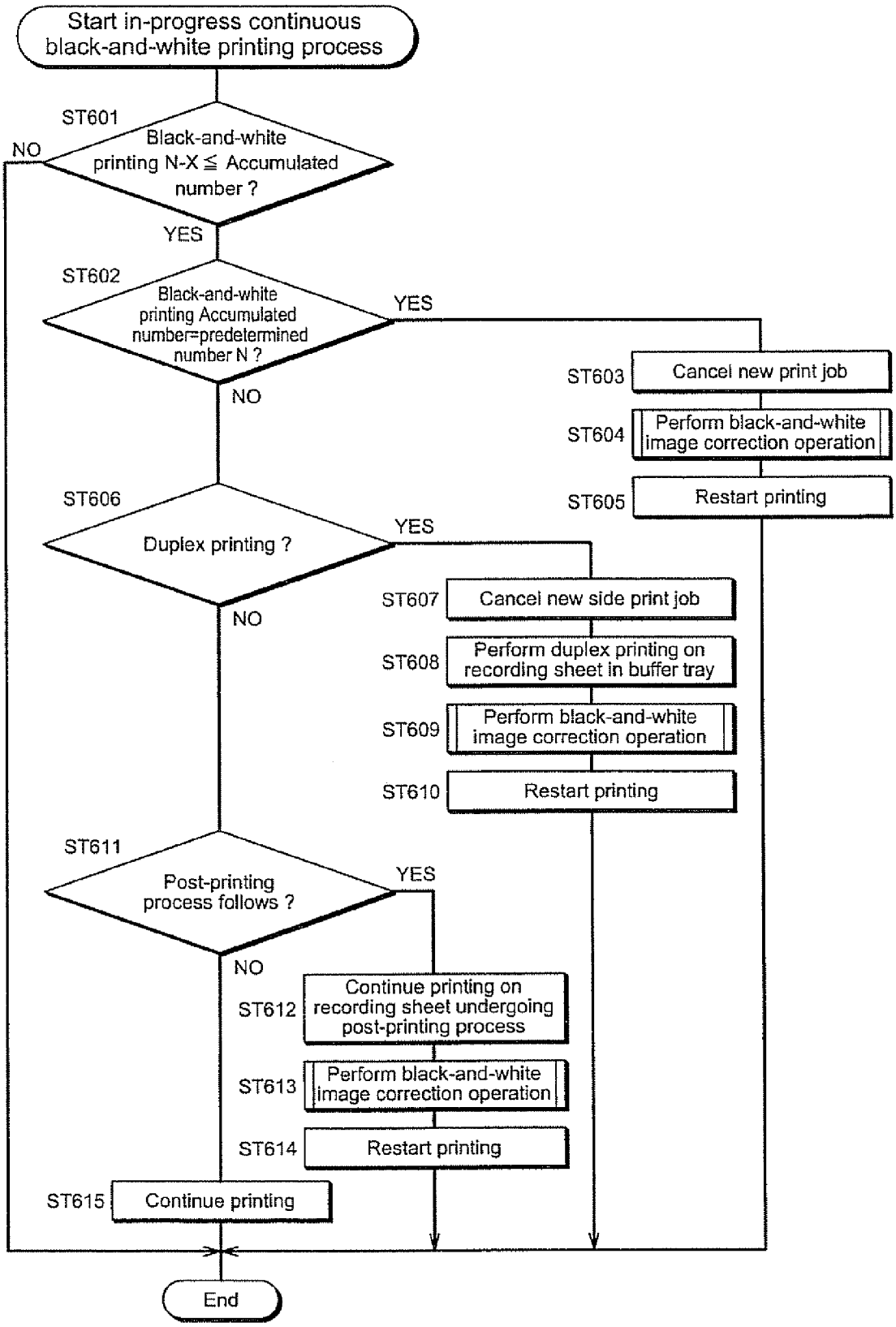
FIG. 12 is a flowchart illustrating an advancing process of the image correction operation.

As shown in FIG. 9, after the user instructs a print job, one page is printed (ST301), after which it is determined whether the print job has been completed (ST302). When the print job is completed, a standby process shown in FIG. 10 is performed (ST303). When there is a new print job afterwards (ST304; Yes), the operation returns to ST301 and the same operations are performed. On the other hand, when the print job has not been completed in ST301, an in-progress continuous printing process shown in FIG. 11 or FIG. 12 is performed (ST305), after which the operation returns to ST301 and the same operations are performed.

FIG. 10 illustrates a detailed standby process in ST304 of FIG. 9. First, it is determined in ST401 whether a predetermined time has elapsed without the user using multifunction apparatus 1 (e.g., when there has been no input key operation of display/operating unit 93 by the user, when there has been no print job data reception from PC 52, or when the printing has been aborted due to no paper). When the predetermined time has elapsed, it is determined, based on a count value indicated by color-printing counter 76, whether the accumulated number of recording sheets has reached a value at which an image correction operation for color-printing can be advanced (ST402). An image correction operation for color-printing is performed when an advancing process can be performed (ST403). On the other hand, when the accumulated number of recording sheets has not reached the value at which an advance image correction operation for color-printing can be performed, it is then determined, based on a count value indicated by black-and-white printing counter 77, whether the accumulated number of recording sheets has reached a value at which an image correction operation for black-and-white printing can be advanced (ST404). An image correction operation for black-and-white printing is performed when an advancing process can be performed (ST405). When an advancing process cannot be performed, no image correction operation is performed, thereby completing the standby process.

When the predetermined time has not elapsed in ST401, it is determined whether the power-save mode is on (ST406). When the power-save mode is on (ST406: Yes), it is further determined in ST407 whether multifunction apparatus 1 has been automatically switched to the power-save mode (i.e., the predetermined time has elapsed without the user using multifunction apparatus 1). When multifunction apparatus 1 is automatically switched to the power-save mode, ST408 and ST409, which are identical to the above-noted ST402 and ST403, or ST410 and ST411, which are identical to the above-noted ST404 and ST405, are performed, after which a power-save process is performed (ST412), thereby completing the standby process. On the other hand, when multifunction apparatus 1 is manually switched to the power-save mode (ST407: No), no image correction operation is performed, thereby completing the standby process.

When the power-save mode is off in ST406 (ST406 No), it is determined whether the sleep mode is on (ST413). When the sleep mode is on, ST414 and ST415, which are identical to the above-noted ST402 and ST403, or ST416 and ST417, which are identical to the above-noted ST404 and ST405, are performed, after which a sleep operation is performed (ST418), thereby completing the standby process.

When the sleep mode is off in ST413, or when multifunction apparatus 1 is manually switched to the power-save mode in ST407 (ST407: No), it has been described above that a series of image correction operations are not performed, thereby completing the standby process. In this case, however, it is preferable that the operation returns to the initial step (ST401) of the standby process in order to monitor whether the power-save mode or the sleep mode is on, and to perform the series of image correction operations.

Further, a predetermined time and a switching time to the power-save mode and the sleep mode are separately controlled in the above embodiment. However, other embodiments are possible to simplify the time control process by, for example, commonizing some parts of the time control process.

FIGS. 11 and 12 illustrate detailed in-progress continuous printing processes in ST305 of FIG. 9. FIG. 11 illustrates an image correction operation for color-printing, and FIG. 12 illustrates an image correction operation for black-and-white printing.

In the image correction operation for color-printing as shown in FIG. 11 when it is first determined, based on a count value indicated by color-printing counter 76, that the accumulated number of recording sheets has reached a value at which an image correction operation for color-printing can be advanced (N−X≦accumulated number) (ST501: Yes), it is further determined, based on the count value indicated by color-printing counter 76, that the accumulated number of recording sheets is equal to the predetermined number N (ST502). When the accumulated number of recording sheets is equal to the predetermined number N, a new print job is temporarily canceled (ST503), and an image correction operation for color-printing is performed (ST504). Then, printing restarts (ST505), after which the in-progress continuous printing process is completed.

When the accumulated number of recording sheets is smaller than the predetermined number N in ST502, it is determined in ST506 whether an in-progress print job is for duplex printing. When the in-progress print job is for duplex printing, a new print job is temporarily canceled (ST507). After duplex printing is completed on a recording sheet having one side printed, which remains in reversing unit 22 or the like (ST508), an image correction operation for color-printing is performed (ST509). Then, printing restarts (ST510), after which the in-progress continuous printing process is completed.

When the in-progress print job is not for duplex printing, it is determined whether a post-printing process is necessary (ST511). When a post-printing process is necessary, printing continues until all the operations for a collection bf recording sheets are completed (ST512), after which an image correction operation for color-printing is performed (ST513). Then, printing restarts (ST514), after which the in-progress continuous printing process is completed.

Although it is not shown here, an image correction operation for color-printing is performed, when the accumulated number of recording sheets has reached a predetermined number needed for forcible execution while printing is in progress in ST512 (accumulated number=N).

On the other hand, in the image correction operation for black-and-white printing shown in FIG. 12, when it is first determined, based on a count value indicated by black-and-white printing counter 77, that the accumulated number of recording sheets has reached a value at which an image correction operation for black-and-white printing can be advanced (N−X≦accumulated number) (ST601: Yes), it is further determined, based on the count value indicated by black-and-white printing counter 77, whether the accumulated number of recording sheets is equal to the predetermined number N (ST602). When the accumulated number of recording sheets is equal to the predetermined number N, a new print job is temporarily canceled (ST603), and an image correction operation for black-and-white printing is performed (ST604). Then, printing restarts (ST605), after which the in-progress continuous printing process is completed.

When the accumulated number of recording sheets is smaller than the predetermined number N in ST602, it is determined whether the in-progress print job is for duplex printing (ST606). When the in-progress print job is for duplex printing, a new print job is temporarily canceled (ST607). After duplex printing is completed on a recording sheet having one side printed, which remains in reversing unit 22 or the like (ST608), an image correction operation for black-and-white printing is performed (ST609). Then, printing restarts (ST610), after which the in-progress continuous printing process is completed.

When the in-progress job is not for duplex printing, it is determined whether a post-printing process is necessary (ST611). When a post-printing process is necessary, printing continues until all the operations for a collection of recording sheets undergoing a post-printing process are completed (ST612), after which an image correction operation for black-and-white printing is performed (ST613). Then, printing restarts (ST614), after which the in-progress continuous printing process is completed.

Although it is not shown here, an image correction operation for black-and-white printing is performed, when the accumulated number of printing sheets has reached a predetermined number for forcible execution while printing is in progress in ST612 (accumulated number N).

The present invention has been illustrated in detail based on the specific embodiments. However, these embodiments are merely examples, and the present invention is not limited to these embodiments. For example, the image forming operations of the present invention are not limited to those shown in FIGS. 4 and 6. It is further possible to omit a part of these operations or add other operations.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2005-109796 filed on Apr. 6, 2005 entire content of which is expressly incorporated by reference herein.

What is claimed is:

1. An image forming apparatus comprising:

an image former that includes a plurality of photoconductors for forming a plurality of color images and includes a belt on which the plurality of the color images are transferred; and a controller configured to perform a color shift correction for color printing when a number of printings formed by the image former reaches a predetermined value, the color shift correction serving to correct a color shift where the plurality of the color images are shifted on the belt, the controller being further configured to perform the color shift correction when the number of printings formed by the image former reaches another value, the another value being smaller than the predetermined value, wherein, when the number of printings formed by the image former reaches the another value, the controller determines whether the image forming apparatus is on standby and whether a predetermined time period has elapsed after completion of the last print job, and the controller performs the color shift correction when it is determined that the image forming apparatus is on standby and that a predetermined time period has elapsed after completion of the last print job.

2. The image forming apparatus according to claim 1, wherein when the number of printings formed by the image former reaches the another value, the controller determines whether the image forming apparatus is on standby and whether the image forming apparatus has been switched into a power save mode after an operation has not been performed by a user of the image forming apparatus for a predetermined time, and the controller performs the color shift correction when it is determined that the image forming apparatus is on standby and that the image forming apparatus has been switched into the power save mode.

3. The image forming apparatus according to claim 1, wherein when the number of printings formed by the image former reaches the another value, the controller determines whether the image forming apparatus is on standby and whether the image forming apparatus has been switched into a sleep mode, based on an instruction of a user of the image forming apparatus, after the image forming apparatus was switched into a power save mode, a power consumption of the sleep mode being less than a power consumption of the power save mode, and the controller performs the color shift correction when it is determined that the image forming apparatus is on standby and that the image forming apparatus has been switched into the sleep mode.

4. The image forming apparatus according to claim 1, wherein when the number of printings formed by the image former reaches the another value, the controller determines whether a post-printing operation is being performed after printing, and the controller performs the color shift correction when it is determined that a post-printing operation has been completed.

5. The image forming apparatus according to claim 4, wherein the post-printing operation comprises one of sorting, stapling, and punching.

6. The image forming apparatus according to claim 1, wherein when the number of printings formed by the image former reaches the another value, the controller determines whether a print medium having one printed side is present in a reversing section when duplex printing is being performed, the print medium being reversed for printing on an other side in the reversing section, and the controller performs the color shift correction when it is determined that the print medium having one printed side is not present in a reversing section.

7. The image forming apparatus according to claim 1, wherein the controller further performs an image correction for a black-and-white printing, the another value includes a first value for the color printing and a second value for the black-and-white printing, the controller performs the color shift correction when the number of the color printings formed by the image former reaches the first value, and the controller performs the color shift correction when the number of the black-and-white printings formed by the image forming unit reaches the second value.

8. The image forming apparatus according to claim 1, wherein the another value is utilized for the color shift correction when a predetermined condition is satisfied and the predetermined value is utilized for the color shift correction when the predetermined condition is not satisfied.

9. The image forming apparatus according to claim 1, further comprising a fuser that fuses a toner image on a print medium, a temperature of the fuser being lower when the image forming apparatus is in a power save mode then while fusing a toner image.

10. A method for forming an image using an image forming apparatus, the image forming apparatus including a plurality of photoconductors for forming a plurality of color images and a belt on which the plurality of the color images are transferred, the method comprising:

performing a color shift correction for color printing when a number of printings formed by the image forming unit reaches a predetermined value, the color shift correction being performed for correcting a color shift where the plurality of the color images are shifted on the belt; and performing the color shift correction when the number of printings formed by the image forming unit reaches another value, the another value being smaller than the predetermined value, wherein the performing of color shift correction at another value occurs when a predetermined condition is satisfied and performing of color shift correction at the predetermined value is performed when the predetermined condition is not satisfied.

11. The method for forming an image according to claim 10, wherein the predetermined condition relates to a post printing process.

12. The method for forming an image according to claim 10, wherein the predetermined condition relates to duplex printing of a recording sheet.

13. The method for forming an image according to claim 10, wherein the predetermined condition relates to a stand-by mode of the image forming apparatus.

14. An image forming apparatus comprising:

an image former that includes a plurality of photoconductors configured to form a plurality of color images; and a controller configured to perform a color shift correction when a number of images formed by the image former reaches a predetermined value, the color shift correction serving to correct a color shift where the plurality of color images are shifted with respect to each other, the controller further configured to perform a color shift correction when the number of images formed by the image former reaches another value upon the occurrence of a predetermined condition, the another value being smaller than the predetermined value, wherein the predetermined condition comprises the image forming apparatus being in a stand-by mode and a predetermined time period elapsing after completion of a last print job.

15. The image forming apparatus according to claim 14, wherein the predetermined condition comprises the image forming apparatus being in a stand-by mode and the image forming apparatus having been switched into a power save mode after an operation has not been performed for a predetermined time.

16. The image forming apparatus according to claim 14, wherein the another value comprises a first value for color printing and a second another value for black and white printing, the controller performing color shift correction when a number of color printings formed by the image former reaches the first value and the controller performs color shift correction when a number of black and white printings by the image forming apparatus reaches the second value.

17. The image forming apparatus according to claim 14, wherein the predetermined condition relates to a post printing process.

18. The image forming apparatus according to claim 14, wherein the predetermined condition relates to duplex printing of a recording sheet.

19. The image forming apparatus according to claim 14, wherein the predetermined condition relates to a stand-by mode of the image forming apparatus.

20. The image forming apparatus according to claim 14, wherein the another value has a first value when the operation status of the image forming apparatus is on stand-by and a second value when the operation status of the image forming apparatus is in operation.

* * * * *